US006166365A

United States Patent [19]

Simonetti et al.

[11] Patent Number: 6,166,365

[45] Date of Patent: Dec. 26, 2000

[54] PHOTODETECTOR AND METHOD FOR MANUFACTURING IT

[75] Inventors: John J. Simonetti, Hamilton Square, N.J.; Raimund Barden, Oestrich-Winkel, Germany

[73] Assignees: Schlumberger Technology Corporation, Ridgefield, Conn.; Heimannn Optoelectronics GmbH, Wiesbaden, Germany

[21] Appl. No.: 09/116,520

[22] Filed: Jul. 16, 1998

[51] Int. Cl.[7] ..... H01J 43/04; H01J 43/06

[52] U.S. Cl. ..... 250/207; 250/214 VT; 313/534; 313/103 CM

[58] Field of Search ..... 250/207, 214 R, 250/214 A, 214 LA, 239, 214 VT; 313/532, 539, 542, 103 R, 103 CM, 534

[56] References Cited

U.S. PATENT DOCUMENTS

| | | | |
|---|---|---|---|
| 3,243,628 | 3/1966 | Matheson | 313/103 |
| 3,634,690 | 1/1972 | Grant | 250/207 |
| 4,671,778 | 6/1987 | Musselman | 445/73 |
| 4,757,229 | 7/1988 | Schmidt et al. | 313/103 |
| 4,967,115 | 10/1990 | Scmidt et al. | 313/103 CM |
| 5,097,173 | 3/1992 | Schmidt et al. | 313/103 |
| 5,632,436 | 5/1997 | Niewold | 228/121 |
| 5,654,536 | 8/1997 | Suyama et al. | 250/207 |
| 5,776,538 | 7/1998 | Pierle et al. | 427/78 |

FOREIGN PATENT DOCUMENTS 0 401 12/1990 European Pat. Off. .

*Primary Examiner*—John R. Lee
*Attorney, Agent, or Firm*—William B. Batzer; David Garrod

[57] ABSTRACT

A photosensor comprises a cathode portion (111) sensitive to radiation and/or particles, an anode portion (114) receiving electrons, an evacuated channel (112, 113, 200) having the cathode portion attached to its one end portion in a vacuum-tight manner and the anode portion attached to its other end portion in a vacuum-tight manner, a conductive or semiconductive layer (107) at least partially covering the inner surface of the evacuated channel, wherein the channel is formed of a tubular member (106). A method of manufacturing a channel electron multiplier comprises the steps of forming a tubular member and a conductive or semiconductive layer at least on parts of its inner surface, forming an anode portion and sealing it to the tubular member, evacuating the tubular member, forming a cathode portion sensitive to radiation and/or particles, and sealing the cathode portion to the evacuated tubular member. The detector may at least partially be packed into a casting compound.

28 Claims, 9 Drawing Sheets

PHOTODETECTOR AND METHOD FOR MANUFACTURING IT

FIELD OF THE INVENTION

The invention relates to a photodetector and to a method for manufacturing the same.

BACKGROUND OF THE INVENTION

FIG. 7 shows known devices. FIG. 7*a* is a photomultiplier tube mainly comprising an evacuated tube having a photocathode 701 with a transparent face plate, an anode 704, between them a multiplier section 702 with a defined number of individual dynodes 703. The photocathode 701 is designed to emit electrons into evacuated space 705, when radiation hits the photocathode. The photoelectrons are accelerated and focused to the first dynode. From left to right, the dynodes receive an increasingly positive voltage from an outside circuitry (not shown), thus accelerating electrons from left to right. Each individual dynode 703 is designed such that it generates, upon incidence of an electron, some secondary electrons drawn to the right side by the voltage of the next dynode to the right. Therefore, an amplifying effect is achieved, and finally a significant signal can be detected at anode 704. Due to the many individual parts to be assembled, the photomultiplier tube of FIG. 7*a* is costly. Besides that, it requires some external circuitry in order to apply the required voltages to the dynodes. It can suffer from instabilities in that electrons generated at the photocathode 701 might lead to charges at the inner walls of the outer housing 712, and, if the outer housing or parts of it are insulating, these charges would produce electric fields that might disturb the path of the electrons.

FIG. 7*b* shows a photomultiplier tube including a channel electron multiplier 711 (CEM), in which the CEM 711 is disposed within an outer housing 712. The outer 543-53.234EP-AP/wa housing 712 is evacuated and has on its left end the photocathode 701 with the transparent face plate. This device is bulky. The device has terminals 713, 714 for applying an accelerating voltage to the CEM 711. The applied voltage drops along a conductive path provided at the inside of the hollow, evacuated CEM 711. The multiplying section 711 in this embodiment is shown with a cone-shaped opening collecting electrons from the photocathode 701 and thereafter a helical portion in which electrons are accelerated by the electrical field caused by the voltage drop. Since along the inner wall of the CEM 711 a current continuously flows (currents ranging from some ten nanoamperes to some ten microamperes and voltages ranging from some hundred volts to some thousand volts), the CEM 711 is heated with a power corresponding to current and voltage drop. Since on the other hand the CEM 711 is disposed in an evacuated housing 712, there is no heat dissipation by convection or thermal conduction, so that the CEM 711 heats up until an equilibrium between heating and cooling by radiation is reached. This leads to electrical instabilities during the warm-up and cool-down phase in the case of high power dissipation. Furthermore, it limits a maximum current flow in the conductive path resulting in a very limited maximum anode current of the device and a small dynamic range.

Due to the bent structure of CEM 711 electrons repeatedly impinge on the walls and therefore cause secondary electrons, thus leading to an amplifying effect, so that at anode 704 a signal can be detected. Amplifications exceeding $10^8$ can be achieved with such a device.

FIG. 7*c* shows a detector known from EP-A-0 401 879. Within a monolithic ceramic body 721 a helical channel 722 is formed. The ends of the channel are terminated by a photocathode (not shown) on the one side and an anode portion on the other side. This device is complicated to manufacture, because forming a helical channel within the monolithic ceramic body and the generation of a conductive or semiconductive layer on the inner wall of the channel requires complex manufacturing techniques.

FIG. 7*d* shows an electron multiplier known from U.S. Pat. No. 3,243,628. It comprises a tubular body 731 coated at its inside with a resistive secondary emissive means 732.

FIG. 7*e* shows a tubular photocell known from U.S. Pat. No. 3,634,690. Here, a cathode 701 and an anode 704 are attached to the ends in lengthwise direction of a tube.

SUMMARY OF THE INVENTION

It is the object of the invention to provide a high performance, low noise, moderate cost, small, reliable detector, as well as a manufacturing method rendering the above detector.

This object is accomplished in accordance with the features of the independent claims. Dependent claims are directed on preferred embodiments of the invention.

BRIEF DESCRIPTION OF THE DRAWINGS

In the following, embodiments of the invention will be described with reference to the accompanying drawings, in which.

DETAILED DESCRIPTION OF THE PREFERRED EMBODIMENT(S)

Figure 1:
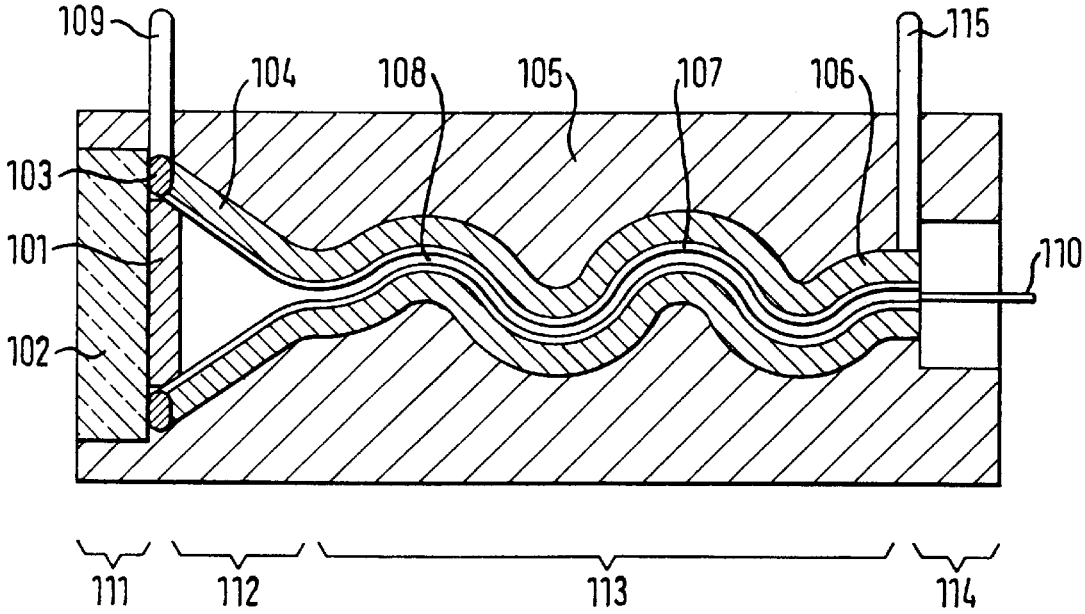
FIG. 1 is a schematical representation of a first embodiment.

FIG. 1 shows schematically a first embodiment according to the invention. The detector comprises a cathode portion 111, a channel portion 112, 113 and an anode portion 114. The cathode portion 111 comprises a photocathode layer 101 which emits electrons upon incidence of radiation and/or particles.

The cathode layer 101 is disposed on a support 102. This support is transparent for the radiation and/or particles to be detected. The support may, e.g., be formed by optical glass, lead glass, quartz glass, or crystal windows, like magnesium fluoride, calcium fluoride, sapphire, or the like. The channel portion confines an elongated channel 108. This channel is evacuated once the device is assembled. The channel portion is substantially formed by a tubular member 106. The tubular member 106 itself is elongated. In order to keep it evacuated, it is closed in a vacuum-tight manner at its one end portion with the cathode portion and at its other end portion with an anode portion. Before assembling the sensor, the tubular member may be formed separately and may therefore be thereafter modified to adapt it to its function. The ratio between length of the tubular member to the inner channel diameter 113 is typically between 20:1 and 200:1, preferably between 30:1 and 100:1. The cross-section of the tubular member may be circular, oval, rectangular or similar. A circular cross-section is preferred. The cross-section of the cathode may be circular. In special applications it can also be rectangular, oval, multiangular or the like.

The inner wall 107 of the tubular member 106 is at least partially covered with a conductive or semiconductive layer 107. This layer has various functions: It is a target for electrons coming either from the photocathode or from other portions of the layer 107 and emits secondary electrons upon incidence of one single electron. Since, on average, more electrons are emitted than absorbed, an amplifying effect can be observed along the length of the layer. The layer further supplies those electrons to be emitted. Besides that, the layer provides for a voltage drop along the channel, this voltage drop accelerating electrons and secondary electrons towards positive potentials such that the increasing number of electrons is directed towards the anode. Therefore, an appropriate voltage is applied across the length of the channel (or at least across a part of the length) and, particularly, the voltage is applied to the conductive or semiconductive layer. The layer therefore will primarily have to be designed such that a certain resistance is obtained (in order to obtain a desired current through the layer at the appropriate voltage) and such that the desired capability of emitting secondary electrons is obtained.

The anode portion 114 collects the electrons/secondary electrons generated along the channel in response to incidence of a photon/particle on the cathode. Therefore, an electrical signal can be observed at the anode in response to a photon, a bunch of photons, or a particle having hit the cathode layer 101.

The layer 107 need not cover the channel portion 112, 113 along its full length. Preferably, however, it surrounds the channel 108 completely in the circumferential direction. FIG. 1 shows an embodiment in which layer 107 covers the channel 108 along its entire length between cathode portion 111 and anode portion 114. The above-mentioned voltage may be applied to layer 107 via terminals 109, 115.

Cathode portion 111 and anode portion 114 are attached to the end portions of the tubular member 106 forming channel 107 in a vacuum-tight manner. Before assembly, the channel 108 is evacuated. Thereafter, it is closed such that channel 108 remains evacuated.

The sensor may advantageously, but not necessarily, comprise a casting compound 105 which is formed around at least parts, preferably all of the channel and preferably also at least around side regions of cathode portion 111 and anode portion 114. The function of the casting compound is to protect the device against mechanical impacts and provide high voltage insulation. It may therefore be selected in order to accomplish this. One further criterium is its capability of conducting heat in order to lead away heat generated by the current flowing through layer 107.

The basic steps of manufacturing the above device are therefore as follows: First, the tubular member 106 is formed. Forming in this context also means giving it shapes as desired under further aspects. E.g., the channel portion 112, 113 may be formed by a tubular member 106 having a first reducing portion 112 with a substantially conical shape and a second portion 113 with a more or less constant cross-section. This step may also include forming layer 107 at the inner wall of the tubular member 106. The first reducing portion 112 reduces the diameter and/or the cross-sectional dimension of the channel in a direction from the cathode towards the anode. Preferably, it has a cross-sectional area and shape corresponding to that of the cathode portion at its cathode side end, and has a diameter and area corresponding to the second portion at its anode side end. The cross-sectional shapes and/or areas may be selected in accordance with the requirements of those portions connecting the respective sides of the first reducing portion 112.

An appropriately shaped anode portion 114 may be formed and attached to the tubular member in a vacuum-tight manner by known techniques.

Besides that, a cathode portion has to be formed. This means that a cathode layer 101 has to be disposed on substrate 102. Most of the known materials for a cathode layer are sensitive against ambient air, so that forming the cathode portion is usually done under vacuum where the desired cathode layer material is disposed on substrate 102.

Then, the entire arrangement is closed by attaching the cathode portion 111 in a vacuum-tight manner to the channel portion 112, 113. Channel 108 was evacuated beforehand. Preferably, therefore, evacuating channel 108, forming cathode layer 101 and sealing cathode portion 111 to channel portion 112, 113 is therefore done during one session in a vacuum system.

Figure 7A:
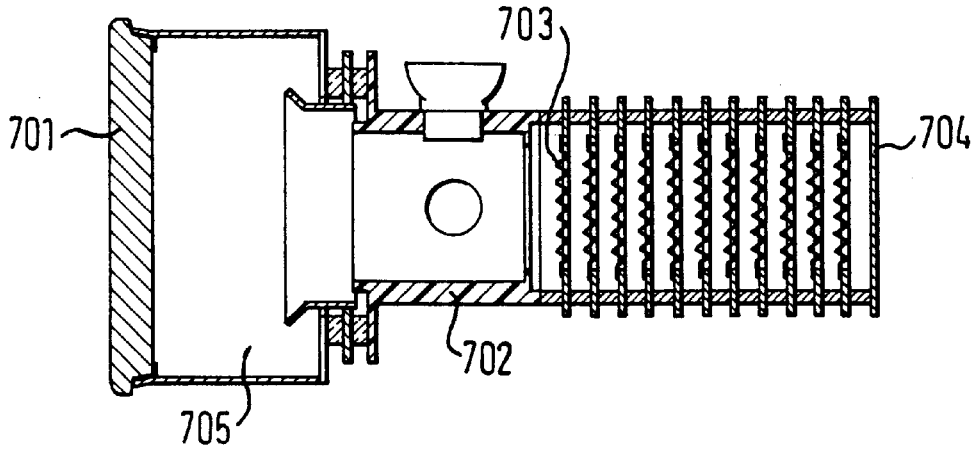
FIGS. 7A to 7B are representations of known multipliers.
Figure 7B:
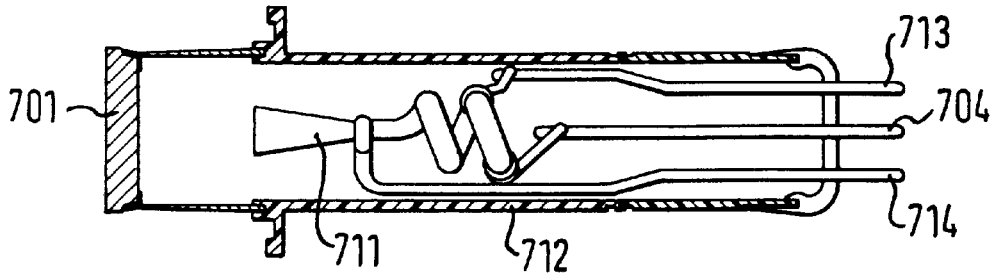
Figure 7C:
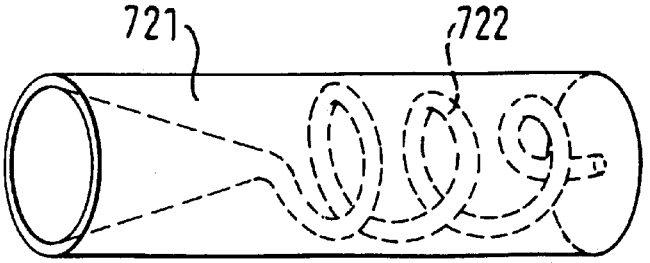
Figure 7D:
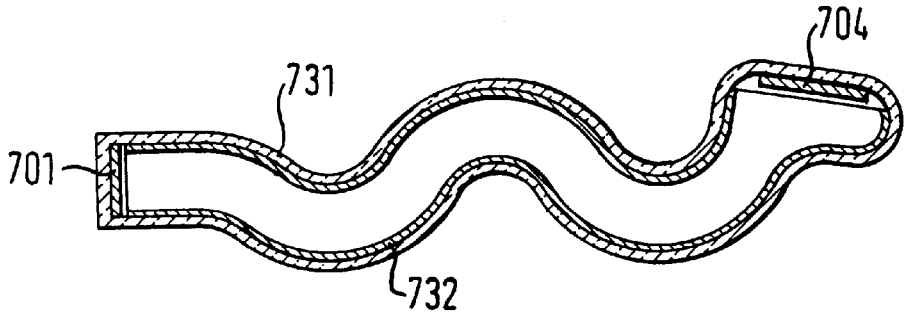
Figure 7E:
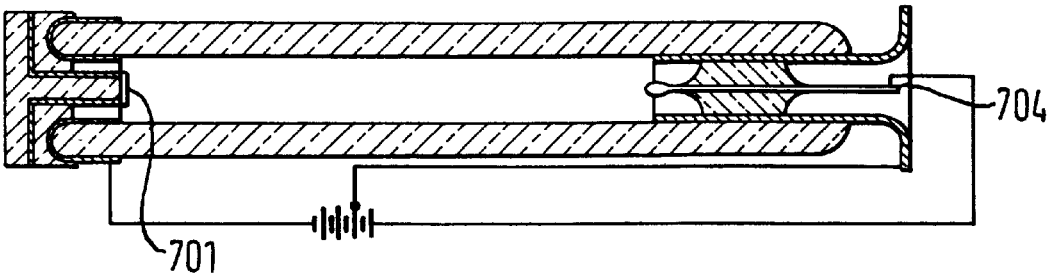

With the above-described construction and method, a high performance, low noise sensor can be formed which consists only of a small number of parts leading to moderate manufacturing costs in high-volume production. Besides that, the obtained device can be made small in size. In contrast to the embodiment shown in FIG. 7B, the heat generated in the conductive or semiconductive layer 107 can be led away by thermal conductivity. Therefore, higher currents are possible, resulting in an improved dynamic range of the detector. Thermal and electrical stability are strongly improved.

As a material for the tubular member 106, glass, lead glass or lead-bismuth glass may be used. The layer 107 may be formed by reducing lead or lead-bismuth glass with heated hydrogen guided through channel 108 before assembling the sensor. It is also possible to use a tubular member formed of glass or ceramics and to coat it with lead or lead-bismuth glass. Volume-conductive materials are also possible.

Bends and/or curves may be provided in order to reduce the mean free path for both the electrons (thus increasing their likelihood of hitting the wall and causing secondary electrons) and the residual positively charged gas ions travelling towards the cathode (such that they gain only little energy and therefore will not be able to cause further secondary electrons when hitting the wall).

After the above-mentioned assembly, it may be packed into a casting compound in order to provide for further mechanical protection. Silicone compounds are appropriate materials, as well as some plastic material, e.g., polyurethane.

The seal between the cathode portion 111 and the channel portion 112, 113 preferably comprises indium or an indium alloy. Indium and its alloys have a low melting point, and the gas pressure of these materials is low, so that the vacuum within the assembled CEM will not be disturbed by processes occurring in or together with the sealing material.

In a preferred embodiment, the indium (alloy) seal 103 between cathode portion 111 and channel portion 112, 113 serves to contact both cathode layer 101 and the conductive/semiconductive layer 107 in the channel. The seal is made electrically accessible from the outside by providing a terminal 109 connected with the seal 103. Then the seal 103 has the triple function of vacuum-tight sealing the cathode portion 111 to the channel portion 112, 113, contacting the cathode layer 103 and contacting the layer 107.

Preferably, an indium alloy is used, e.g., an indium-tin alloy or an indium-bismuth alloy. Preferably, the alloy is in an eutectic alloy.

The vacuum-tight seal between cathode portion 111 and channel portion 112, 113 is usually a glass/indium (alloy)/glass-connection, because both support 102 and tubular member 104, 106 are made of some kind of glass. In order to improve adherence of the alloy to one of the glass surfaces, said surface may be polished and/or be provided with a metallic primer layer. Preferably, those glass surfaces contacting seal 103 are firstly polished and, thereafter, provided with a metallic layer which may, e.g., be evaporated on the polished surfaces. Thereafter, under vacuum conditions, the cathode portion 111 is attached to the channel portion 112, 113 in a vacuum-tight manner by providing the indium alloy connection. Preferably, both surface portions (on support 102 and tubular member 104, 106) coming in contact with seal 103 are treated in the above-mentioned manner.

Figure 2A:
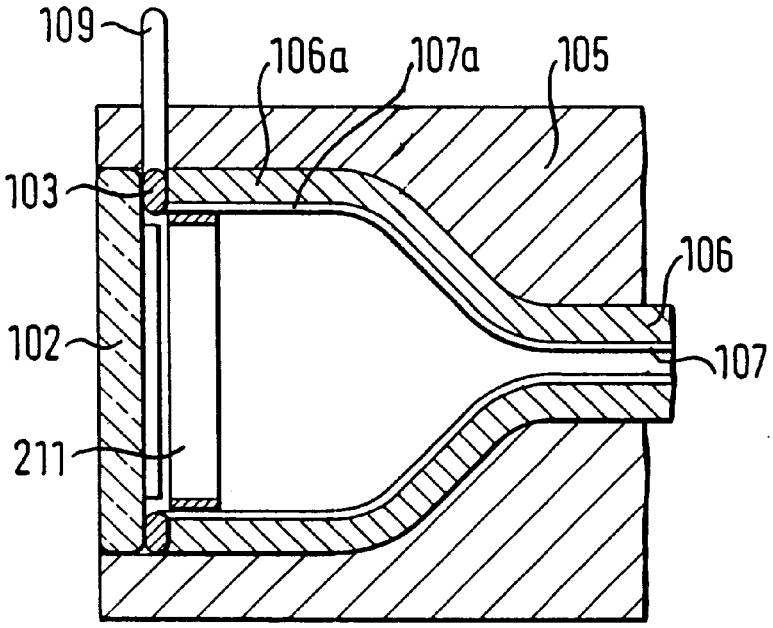
FIGS. 2A to 2C are embodiments of the cathode portion.

FIG. 2A shows another embodiment of the cathode portion. The channel region 112, 113 is only partially shown. It again has a cone-shaped portion 112 and a portion 113 with more or less constant diameter. Nevertheless, additionally between the cathode and the first reducing portion a third portion 106*a* with substantially constant cross section is provided. This third portion may be formed as one piece 106*a* together with the tubular member 106. Further, the inner wall of the third portion 106*a* may also be covered with conductive or semiconductive layer 107*a*. The conductive or semiconductive layer 107, 107*a* therefore extends from the photocathode towards the anode.

Besides that, a focussing electrode 211 may be provided. The focussing electrode 211 is provided on the inner wall of the third portion 106*a* adjacent to the cathode portion. It is ring-shaped (in case that third portion 106*a* has circular cross section) and provided over the entire circumference of the inner wall of the third portion 106*a*. The ring-shaped focussing electrode 211 extends away from the cathode and covers a part of the inner wall of the third portion 106*a*. Preferably, it covers ⅕ to all of the length of the third portion 106*a* in longitudinal direction. It is electrically connected with seal 103 and therefore receives cathode potential. The focussing electrode can be a conductive (metallic) layer with low resistance provided on the inner wall of the third portion 106*a*. It also may be a metal ring.

Figure 2B:
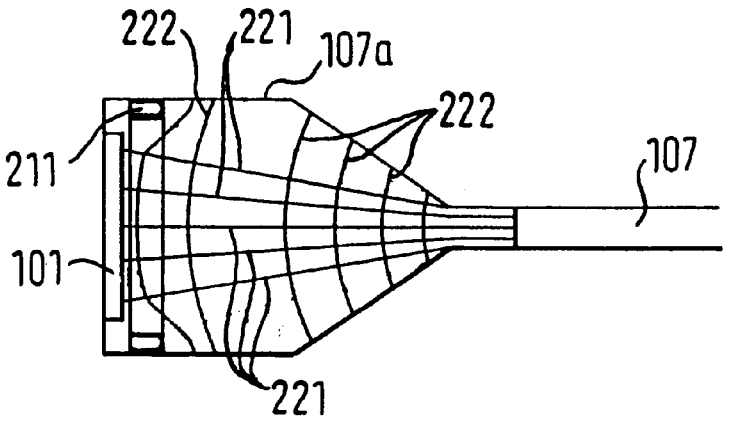

The effect of the focussing electrode is shown with reference to FIG. 2B. Since focussing electrode 211 has cathode potential, it serves to push away free electrons from the side walls of third portion 106*a* to which free electrons would otherwise be attracted due to the potential difference between cathode and layer 107*a* (along which voltage continuously drops from anode to cathode). Numeral 221 shows the trajectories which correspond to the paths of the free electrons, reference numeral 222 shows the equipotential lines. Since the electrons are pushed away from the side walls of third portion 106*a* and from the wide portions of cone 104, they impinge on the wall for the first time close to the opening of the channel 108 or within the channel only. This has the effect that they gathered higher kinetic energy so that their capability of generating secondary electrons is enhanced.

Figure 2C:
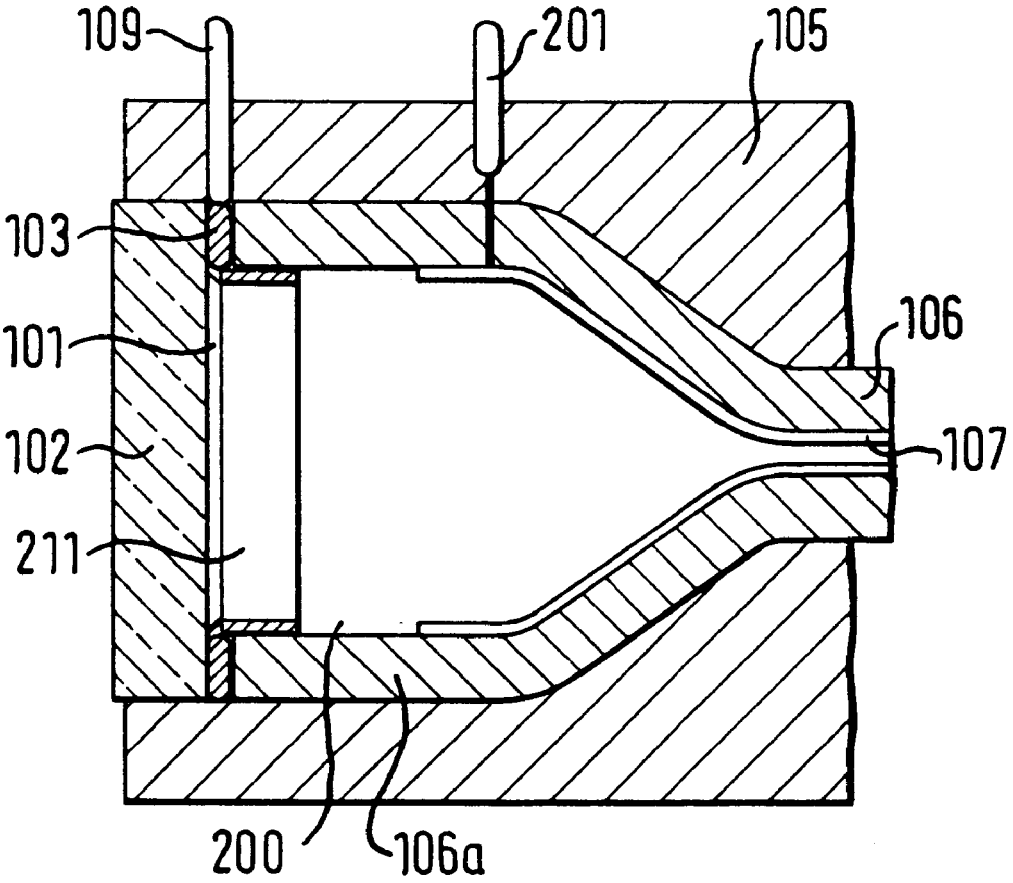

FIG. 2C shows another embodiment of the portion of the detector near the cathode. Unlike the embodiment of FIG. 2A, an intermediate portion 200 is provided at the third portion 106*a*. This intermediate portion is not or only partially coated with layer 107. Seal 103 is provided between cathode portion 111 and third portion 106*a*. It provides the vacuum-tight connection between these two portions and further contacts cathode layer 101. Since, however, intermediate portion 200 does not have layer 107, the seal cannot be used for contacting said layer 107. This layer is contacted separately with its own contact 201 by known techniques.

The arrangement of FIG. 2C allows to apply a potential difference between cathode portion 111 and the entrance of cone portion 112. This has an advantageous effect, because the collision energy of the photoelectrons on layer 107 can be optimized with respect to the secondary emission.

The focussing electrode 211 in FIG. 2C has similar effects as described with reference to FIGS. 2A and 2B. In particular, it prevents to a large extent electrons from impinging on the inner insulating wall of intermediate portion 200, thus also preventing a chargeup of this wall.

Seal 103 is provided between cathode portion 111 and third portion 106*a*. It provides the vacuum-tight connection between these two portions and further contacts cathode layer 101 and focussing electrode 211.

Figure 3:
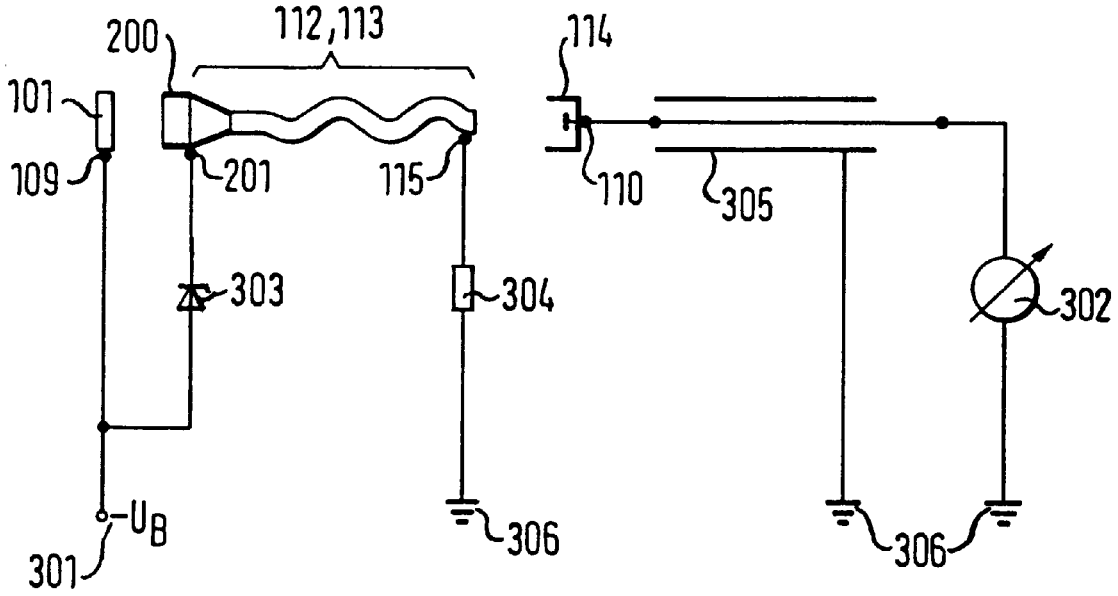
FIG. 3 is a representation of one possible circuitry for the detector.

FIG. 3 shows a connection scheme for the sensor embodiment of FIG. 2. A preferably constant DC voltage $-U^B$ is applied between terminal 109 and anode in FIG. 1, thus providing for the voltage drop necessary for accelerating the electrons from left to right. Plus is connected to the anode, minus to terminal 109. The voltage may lie in a range of some hundred to some thousand volts. Preferably, the voltage is between 1000 and 4000 volts. The resistance of the conductive/semiconductive layer 107 is adjusted such that a current flows which is sufficiently large as compared to the current caused by the regular operation of the device, i.e., the electrons and secondary electrons moving from left to right through the channel 108. Preferably, the current ranges between some hundred nanoamperes and some hundred microamperes, e.g., 10 to 100 microamperes. With values of, e.g., 2000 volts and 10 microamperes, a heating power of 100 mW is obtained. The finally desired signal can be detected at the anode electrode 110 as a voltage pulse against ground 306 or as a current flow. The DC voltage is applied by a voltage source 301. The anode voltage pulse or the anode current may be measured with an appropriate meter 302. Since in the embodiment schematically shown in FIG. 3 the intermediate section 200 is provided, cathode layer 101 is not electrically connected with layer 107 of channel 112, 113. Voltage supply to channel 112, 113 is accomplished via an appropriate element 303 connected to voltage source 301. This element provides for a voltage drop between terminal 201 (FIG. 2) and terminal 109 (FIG. 1). The entrance of channel 112, 113 is therefore positively biased as compared to cathode layer 101. The bias may be between 30 and 300 volts, preferably around 100 volts. Element 303 may be a Zener diode, a resistor, a voltage source or the like. 304 is a resistor, a Zener diode or a voltage source providing a potential difference between terminal 115 and terminal 110 of 10 to 100 volts. The anode is connected via terminal 110 to a shielded wire 305, preferably a coax cable, or a non-shielded wire. The cable 305 connects terminal 110 with meter 302. In FIG. 3, the anode is put to ground potential and the cathode to $-U_B$. In some applications, it is advantageous to put the cathode to ground and the anode to $+U_B$ potential.

Figure 4:
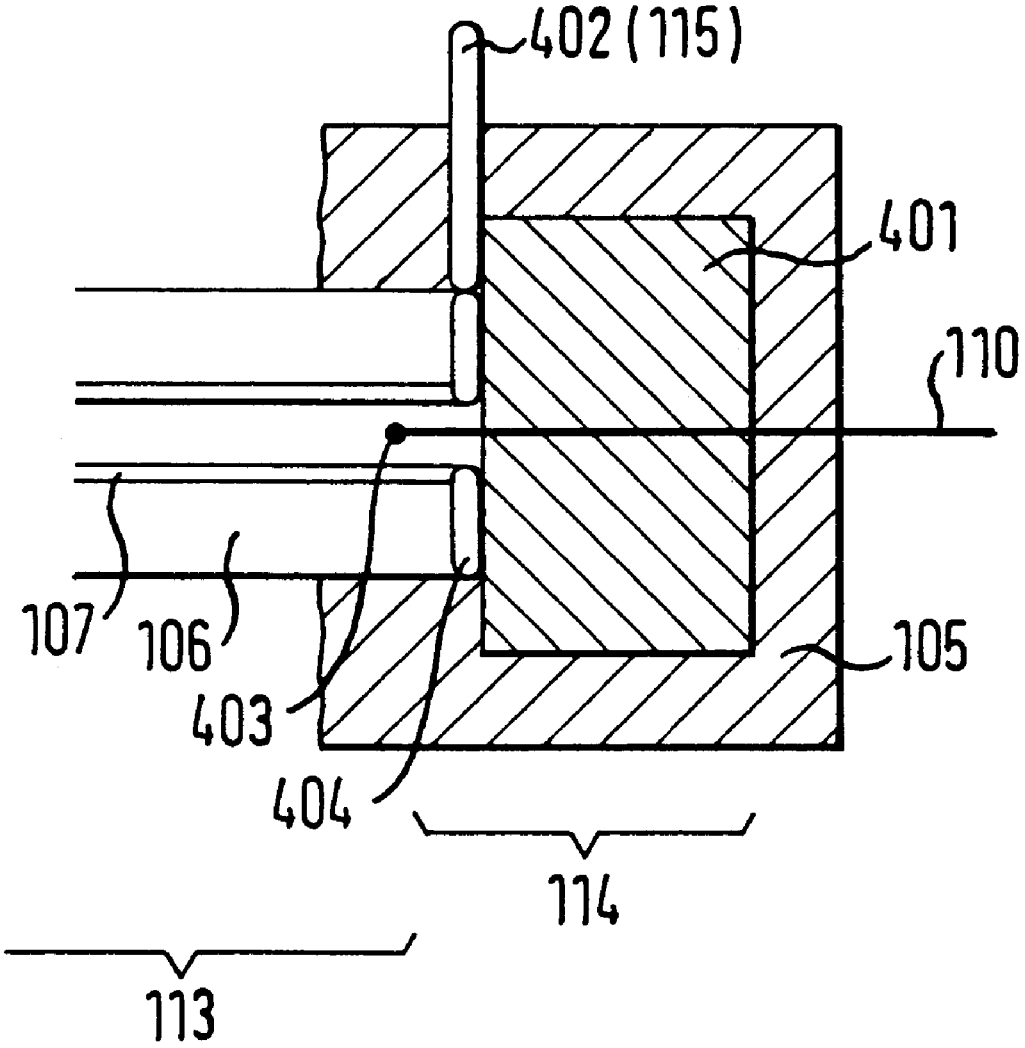
FIG. 4 is an embodiment of an anode region.

FIG. 4 shows schematically the anode portion. Same numerals as in FIG. 1 are same components. 401 is an insulator carrying a target electrode 403. Target electrode 403 is connected with terminal 110. The electrons finally to be detected will hit target electrode 403 and lead there to a signal which can be detected. A seal 404 is provided between tubular member 106 and insulator 401. Seal 404 is again a vacuum-tight seal attaching insulator 401 to tubular member 106.

In one embodiment, target electrode 403 is electrically in-sulated against layer 107, which means that layer 107 requires at its anode-side end an own terminal 402. This electrical separation of anode-side end of layer 107 and target electrode 403 allows the sensor to be used in analogue DC mode, and not only in photon-counting mode and in pulse mode, e.g., for spectroscopic application with scintillating material. In another embodiment, layer 107 may electrically be connected with target electrode 403, thus making one of the terminals 402, 110 superfluous. Then, however, the analogue DC mode becomes impossible.

The above-described sensor can be made sensitive for particles and hard radiation, like γ-rays and x-rays, by providing—s above—a cathode portion consisting of a photosensitive cathode layer on the vacuum-side of support 102 and additionally providing on the other side of support 102 a scintillating material, emitting photons upon incidence of particles or hard radiation. This layer is exposed to particles or hard radiation, generates photons when particles or hard radiation hit the scintillating layer, these photons passing through transparent support 102 causing free electrons to be emitted from the photocathode 101. These electrons are accelerated towards the anode portion as described above.

Care has to be taken in selecting the materials keeping channel 112, 113 evacuated. This relates therefore to tubular member 106, support 102 and 401 and the various seals employed. It has to be ensured that the evacuated state is maintained as long as possible. One tendency observed by the inventors was that the vacuum in channel 112, 113 degrades due to gas inside the materials confining the channel. Those materials therefore have to be selected such that both their gas-carrying capability and their gas-pressure is low. Reducing their gas-carrying capability in addition to appropriately selecting materials may further be accomplished by treating these materials, e.g., with electrons or by baking them. Only thereafter, the channel is closed in its evacuated state. Besides that, a getter material may be provided in the channel. This getter material absorbs gas evolved in the channel and, therefore, helps to keep channel portion 112, 113 in an evacuated state. Preferably, the getter material is provided at the location of the (indium) seal between cathode portion 111 and channel portion 200, 112, 113.

The above sensors may be sensitive to UV-light, infrared light, visible light, γ- or X-rays or a plurality of these wavelengths, the latter ones when incorporating scintillating layer opposite of support 102. The bent shape of the channel may be bent only in one plane, e.g., following a sinusoidal curve. Nevertheless, a helical curve or other shapes, for example a C-shape, are also possible.

Figure 5:
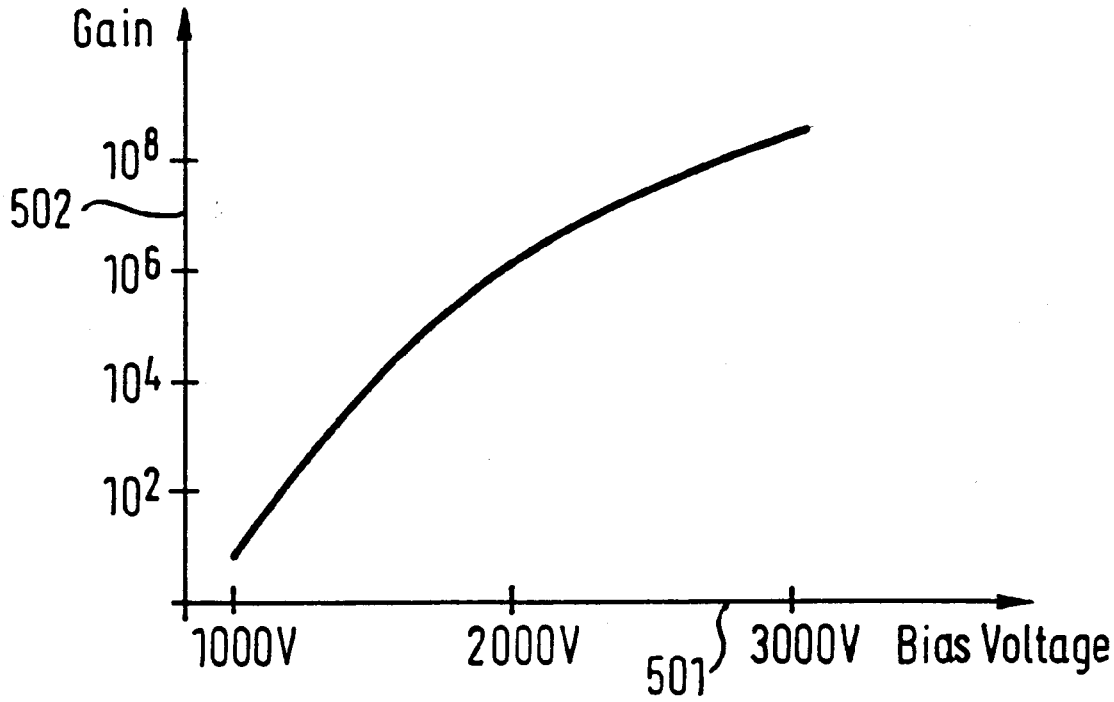
FIG. 5 is a characteristic of a photodetector according to the invention.

Tests performed with the photodetector according to the invention show excellent performance data. Gain of $10^8$ and more was obtained. FIG. 5 shows the gain on ordinate 502 versus applied voltage $U_B$ on abscissa 501.

Figure 6A:
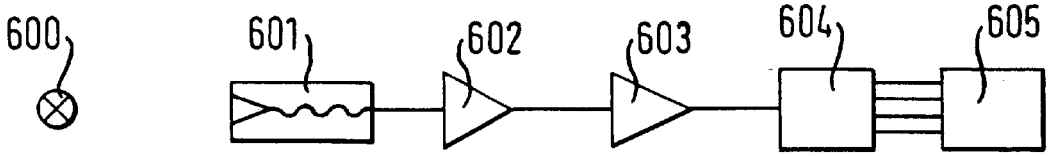
FIGS. 6A to 6B are the representation of a measurement condition and of the results obtained thereby.
Figure 6B:
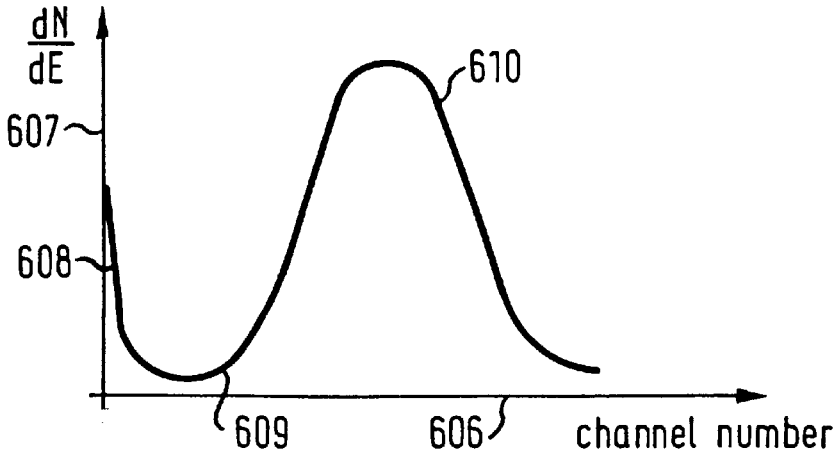

FIG. 6*a* shows a measurement condition for obtaining a single photoelectron spectrum taken from a multi-channel analyzer. The electrical set-up is shown in FIG. 6*a*. A light source 600 illuminates a photodetector 601 formed in accordance with the invention. Its output signal is passed to a charge-sensitive pre-amplifier 602, from there to an amplifier 603, from there to an A/D-converter 604 and from there to a multi-channel analyzer 605. FIG. 6*b* shows the result of measurements. The single photoelectron peak 610 is clearly distinct from electronic background noise 608. Noise 608 and electron peak 610 are clearly divided by valley 609. Peak-to-valley ratio of 10:1 or better can be obtained. In FIG. 6*b*, abscissa 606 shows the channel number, this number being a measure for the electron energy, and ordinate 607 shows the number of hits within one channel.

Experimental data confirm that the photodetector formed in accordance with the invention shows extremely low noise. Using visible photocathodes, e.g., $K_2CsSb$-photocathodes, noise levels down to a few dark counts per second can be obtained. With a maximum count rate up to some tens of Megahertz, a dynamic range of approximately seven orders of magnitudes can be reached.

What is claimed is:

1. A detector for electromagnetic radiation or particles, comprising:

a cathode portion (111) emitting electrons upon incidence of electromagnetic radiation and/or particles;

an anode portion (114) for receiving electrons;

an evacuated channel (106, 106*a*, 108, 112, 113, 200), formed of a glass tube, having the cathode portion vacuum-tight attached to its one end portion and the anode portion vacuum-tight sealed to its other end portion; and a conductive or semiconductive layer (107) emitting secondary electrons upon incidence of primary electrons, said layer at least partially covering the inner surface of the evacuated channel, the channel formed of a tubular member (106) and having a first reducing portion reducing the cross sectional area of the channel in a direction towards the anode portion.

2. A detector according to claim 1, wherein the tubular member comprises lead glass and/or lead-bismuth glass.

3. A detector according to claim 2, wherein said conductive or semiconductive layer is a portion of said lead glass and/or lead-bismuth glass tubular member that has been reduced by hydrogen.

4. A detector according to claim 1, further comprising a casting compound (105) which at least partially encapsulates the tubular member forming the channel.

5. A detector according to claim 4, wherein the casting compound comprises a silicone based material and/or polyurethane.

6. A detector according to claim 1, further comprising:

a metallic seal (103) between the cathode portion and the channel, the seal being electrically connected to the cathode portion (111), and a terminal (109) on the outside of the detector, electrically connected to the seal (103).

7. A detector according to claim 6, wherein the seal comprises indium or an indium alloy.

8. A detector according to claim 7, wherein the seal comprises an indium-tin alloy or an indium-bismuth alloy.

9. A detector according to claim 8, wherein the alloy is an eutectic alloy.

10. A detector according to claim 6, wherein at least one surface contacting said metallic seal has been polished.

11. A detector according to claim 6, wherein at least one surface contacting said metallic seal has been coated with a metallic layer.

12. A detector according to claim 1, further comprising:

a metallic seal (103) between the cathode portion and the channel, the seal being electrically connected to the cathode portion, a terminal (109) on the outside of the detector, electrically connected to the seal, wherein a portion (200) of the channel in the vicinity of the seal is not covered by the conductive or semiconductive layer (107), said layer being electrically connected to a contact (201) puncturing the channel in a vacuum-tight manner.

13. A detector according to claim 12, wherein the channel has an intermediate portion (200) substantially free of the conductive or semiconductive layer (107) and disposed between the cathode portion (111) and the first reducing portion (112), wherein a contact (201) punctures the channel at or close to a transitional portion between third portion and first reducing portion of the channel and is electrically connected to said conductive or semiconductive layer (107).

14. A detector according to claim 1, wherein the channel has a bent portion.

15. A detector according to claim 1, wherein the first reducing portion is a cone-shaped or funnel-shaped portion (112), a second portion (113) preferably has substantially constant cross section, the first portion being disposed between the cathode portion and the second portion.

16. A detector according to claim 1, wherein a third portion (106*a*) with substantially constant cross section is provided between the first reducing portion and the cathode portion.

17. A detector according to claim 16, wherein an electrode (211) is provided at least at parts in circumferential direction of the inner wall of the third portion (106*a*).

18. A detector according to claim 17, wherein the electrode has cathode potential.

19. A detector according to claim 1, wherein a getter material is provided for absorbing gas diffusing into the channel or evolving in the channel during operation.

20. A detector according to claim 19, wherein said getter material is located between said cathode portion and said evacuated channel.

21. A method of manufacturing a detector for electromagnetic radiation or particles, comprising:

(a) forming a glass tubular member and a conductive or semiconductive layer at least on parts of said tubular member's inner surface;

(b) forming an anode portion and attaching said anode portion to the tubular member in a vacuum tight manner;

(c) evacuating the tubular member;

(d) forming a cathode portion sensitive to electromagnetic radiation and/or particles; and (e) attaching the cathode portion to the evacuated tubular member in a vacuum tight manner.

22. The method of claim 21, wherein the steps (c) to (e) are carried out in an evacuated system.

23. The method of claim 21, wherein the tubular member is formed of lead or lead-bismuth glass and the conductive or semiconductive layer is formed by reducing the lead or lead-bismuth glass with hydrogen.

24. The method of claim 21, further comprising, after (e), forming a casting compound around at least a part of the channel.

25. The method of claim 24, wherein the casting compound is formed around the channel and around parts of the cathode portion and/or the anode portion.

26. The method of claim 21, wherein (e) comprises attaching the cathode portion to the tubular member with an indium alloy substance.

27. The method of claim 26, wherein in (e), before attaching the cathode portion to the tubular member, at least one surface coming in contact with the indium alloy seal is polished and/or coated with a metallic layer.

28. A detector for electromagnetic radiation or particles, comprising:

a cathode portion emitting electrons upon incidence of electromagnetic radiation and/or particles;

an anode portion for receiving electrons;

an evacuated channel, formed of a lead and/or lead-bismuth glass tube, having the cathode portion vacuum-tight attached to its one end portion and the anode portion vacuum-tight sealed to its other end portion;

a conductive or semiconductive layer, formed by reducing a portion of said lead glass and/or lead-bismuth glass with hydrogen, emitting secondary electrons upon incidence of primary electrons, said layer at least partially covering the inner surface of the evacuated channel, the channel formed of a tubular member and having a first reducing portion reducing the cross sectional area of the channel in a direction towards the anode portion;

a silicone based material and/or polyurethane casting compound which at least partially encapsulates said tubular member;

a metallic seal between the cathode portion and the channel, at least one surface contacting said metallic seal having been polished and at least one surface contacting said metallic seal having been coated with a metallic layer; and a getter material for absorbing gas diffusing into the channel or evolving in the channel during operation.

* * * * *